US010174551B2

(12) United States Patent
Buccola, Jr. et al.

(10) Patent No.: US 10,174,551 B2
(45) Date of Patent: Jan. 8, 2019

(54) RAIL FOR A COVERING FOR AN ARCHITECTURAL OPENING

(71) Applicant: Hunter Douglas Inc., Pearl River, NY (US)

(72) Inventors: Nickolas C. Buccola, Jr., Brighton, CO (US); Stephen P. Smith, Denver, CO (US)

(73) Assignee: HUNTER DOUGLAS INC., Pearl River, NY (US)

( * ) Notice: Subject to any disclaimer, the term of this patent is extended or adjusted under 35 U.S.C. 154(b) by 0 days.

(21) Appl. No.: 14/859,394

(22) Filed: Sep. 21, 2015

(65) Prior Publication Data

US 2017/0081915 A1 Mar. 23, 2017

(51) Int. Cl.

| | |
|---|---|
| ***E06B 9/388*** | (2006.01) |
| ***E06B 9/36*** | (2006.01) |
| ***E06B 9/264*** | (2006.01) |
| ***E06B 9/34*** | (2006.01) |
| *E06B 9/24* | (2006.01) |

(52) U.S. Cl.

CPC ..... *E06B 9/367* (2013.01); *E06B 9/264* (2013.01); *E06B 9/34* (2013.01); *E06B 2009/2435* (2013.01)

(58) Field of Classification Search

CPC ..... E06B 9/367; E06B 2009/2435; E06B 2009/2447; E06B 2009/2458; E06B 9/388

USPC ..... 160/121.1, 173 R, 84.05

See application file for complete search history.

(56) References Cited

U.S. PATENT DOCUMENTS

| | | | | |
|---|---|---|---|---|
| 1,345,211 | A * | 6/1920 | Milnes | G09F 3/203 160/10 |
| 1,900,769 | A | 3/1933 | Schemmel et al. | |
| 3,280,890 | A | 10/1966 | Preziosi | |
| D229,493 | S | 12/1973 | Feakins | |
| D294,867 | S | 3/1988 | Meshulam | |
| 5,127,458 | A * | 7/1992 | Schaefer | E06B 9/388 160/168.1 R |
| 5,176,192 | A | 1/1993 | Judkins et al. | |
| 5,285,838 | A * | 2/1994 | Rapp | E06B 9/303 160/168.1 R |
| 5,320,154 | A | 6/1994 | Colson et al. | |

(Continued)

FOREIGN PATENT DOCUMENTS

EM 001285118-0001 7/2011

*Primary Examiner* — Katherine W Mitchell
*Assistant Examiner* — Abe Massad
(74) *Attorney, Agent, or Firm* — Fox Rothschild LLP

(57) ABSTRACT

A weighted rail is provided that skews and/or counterbalances an associated shade member to counteract an asymmetric force applied to the rail by the shade member. The rail may include an independent weight that is at least partially positioned rearwardly of a longitudinal axis of the rail, thereby counterbalancing a force applied to the rail by the shade member that tends to rotate the rail about its longitudinal axis. Additionally, or alternatively, the weight may be movable along a length of the rail to counterbalance a force applied to the rail by the shade member that tends to rotate the rail about an axis that is orthogonal to its longitudinal axis and to the plane of the shade member. The rail is attachable to a variety of shade members including, but not limited to, shade members having multiple panels attached to each other with a plurality of vanes.

41 Claims, 5 Drawing Sheets

(56) References Cited

U.S. PATENT DOCUMENTS

| | | | | |
|---|---|---|---|---|
| 5,375,642 | A * | 12/1994 | Gaber | E06B 9/32 160/168.1 R |
| D368,851 | S | 4/1996 | Cole et al. | |
| 5,655,590 | A * | 8/1997 | Bryant | E06B 9/388 160/168.1 R |
| 5,826,638 | A | 10/1998 | Jelic | |
| D412,753 | S | 8/1999 | Colson et al. | |
| D440,100 | S | 4/2001 | Horsten et al. | |
| D440,444 | S | 4/2001 | Sonnenberg et al. | |
| D443,457 | S | 6/2001 | Horsten et al. | |
| 6,412,537 | B1 | 7/2002 | Voss et al. | |
| 6,546,989 | B2 | 4/2003 | Coleman et al. | |
| 6,550,522 | B1 | 4/2003 | Lennon et al. | |
| 6,758,258 | B1 | 7/2004 | Nien | |
| 6,769,471 | B2 * | 8/2004 | Voss | E06B 9/322 160/173 R |
| 6,845,806 | B2 * | 1/2005 | Gottschall | E06B 9/42 160/238 |
| D522,297 | S | 6/2006 | Miller et al. | |
| D530,967 | S | 10/2006 | Smith | |
| D542,068 | S | 5/2007 | Watkins et al. | |
| D546,104 | S | 7/2007 | Miller et al. | |
| D601,274 | S | 9/2009 | Koenig, Jr. | |
| D633,320 | S | 3/2011 | Brace et al. | |
| D675,750 | S | 2/2013 | King | |
| D677,405 | S | 3/2013 | Landis | |
| D680,357 | S | 4/2013 | Wills et al. | |
| 9,322,210 | B2 * | 4/2016 | Lukosiunas | E06B 9/26 |
| D762,462 | S | 8/2016 | Anderson | |
| 9,410,371 | B2 | 8/2016 | Faller et al. | |
| 9,445,684 | B2 * | 9/2016 | Franssen | E06B 9/388 |
| D772,435 | S | 11/2016 | Bonuccelli et al. | |
| 2002/0046816 | A1 | 4/2002 | Judkins | |
| 2005/0224191 | A1 * | 10/2005 | Nien | E06B 9/388 160/173 R |
| 2009/0294076 | A1 | 12/2009 | McNiel | |
| 2011/0056630 | A1 | 3/2011 | Buccola, Jr. | |
| 2014/0262068 | A1 | 9/2014 | Buccola, Jr. et al. | |
| 2015/0034262 | A1 | 2/2015 | Franssen | |
| 2016/0130866 | A1 | 5/2016 | Buccola, Jr. et al. | |

* cited by examiner

RAIL FOR A COVERING FOR AN ARCHITECTURAL OPENING

FIELD

The present disclosure relates generally to coverings for architectural openings, and more particularly to a rail for a covering for an architectural opening.

BACKGROUND

Coverings for architectural openings, such as windows, doors, archways, and the like, have taken numerous forms for many years. Some coverings include a retractable shade member that is movable between an extended position and a retracted position. A movable rail typically is attached to an edge of the shade member to facilitate extension of the shade member across the opening and to maintain the shade member in a taut configuration. Some shade members apply an asymmetric force to the rail, which tends to rotate the rail about its longitudinal axis, about an axis that is orthogonal to its longitudinal axis and to the plane of the shade member, or both.

SUMMARY

Embodiments of the disclosure generally provide a rail, such as a bottom rail, that is attachable to a shade member of a covering for an architectural opening and that skews and/or counterbalances the shade member to counteract an asymmetric force applied to the rail by the shade member. The rail includes a weight that is at least partially positioned rearwardly of a longitudinal axis of the rail, thereby providing an unbalanced or asymmetrical rail to counterbalance a force applied to the rail by an associated shade member that tends to rotate the rail about its longitudinal axis. Additionally, or alternatively, the weight is movable along a length of the rail to counterbalance a force applied to the rail by an associated shade member that tends to rotate the rail about an axis that is orthogonal to its longitudinal axis and to the plane of the shade member. The rail is attachable to a variety of shade members including, but not limited to, shade members having multiple panels, such as shade members having front and rear panels attached to each other with a plurality of vanes, cellular shade members, or other types of shade members.

This summary of the disclosure is given to aid understanding, and one of skill in the art will understand that each of the various aspects and features of the disclosure may advantageously be used separately in some instances, or in combination with other aspects and features of the disclosure in other instances. Accordingly, while the disclosure is presented in terms of embodiments, it should be appreciated that individual aspects of any embodiment can be claimed separately or in combination with aspects and features of that embodiment or any other embodiment.

The present disclosure is set forth in various levels of detail in this application and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. It should be understood that the claimed subject matter is not necessarily limited to the particular embodiments or arrangements illustrated herein.

BRIEF DESCRIPTION OF THE DRAWINGS

The accompanying drawings, which are incorporated into and constitute a part of the specification, illustrate embodiments of the disclosure and, together with the general description given above and the detailed description given below, serve to explain the principles of these embodiments.

DETAILED DESCRIPTION

Figure 1:
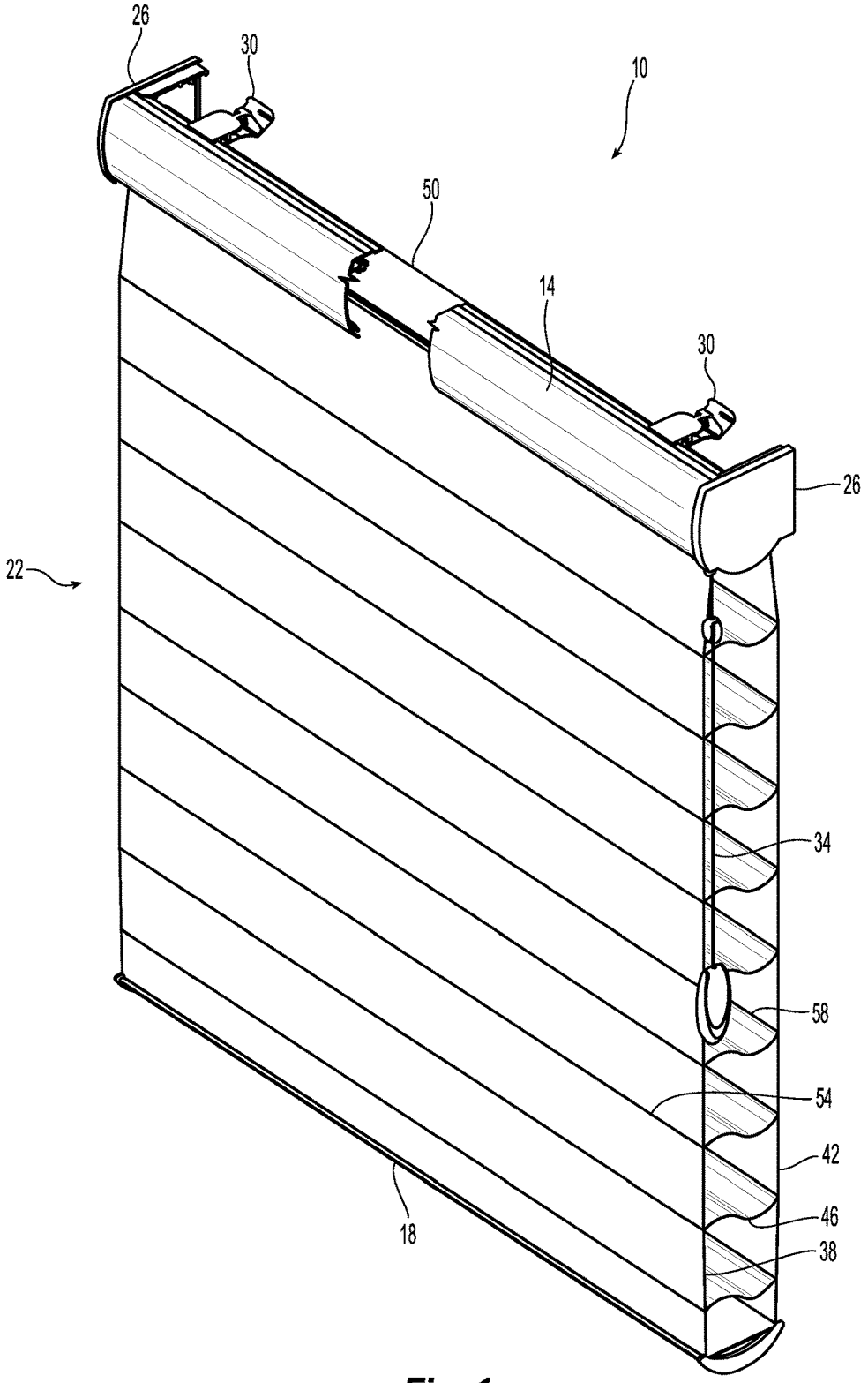
FIG. 1 is a front view of a covering with a shade member in a fully-extended, open configuration in accordance with some embodiments of the present disclosure.

FIG. 1 is a front view of an illustrative embodiment of a covering formed in accordance with principles of the present invention. Covering 10, illustrated in FIG. 1, is shown in a fully-extended, open configuration in accordance with some embodiments of the present disclosure. The covering 10 illustrated in FIG. 1 includes a head rail 14, a movable rail 18, and a shade member 22 extending between the head rail 14 and the movable rail 18. The rail 18 of the illustrative embodiment extends horizontally along a lower edge of the shade member 22 and functions as a ballast to maintain the shade member 22 in a taut condition. The covering 10 may include end caps 26 that enclose the ends of the head rail 14, and mounting brackets 30 for securing the covering 10 to a building structure defining the architectural opening. The covering 10 of FIG. 1 includes a drive mechanism configured to raise or retract the shade member 22, such as a drive pulley and an operating element 34, an electric motor, or other suitable drive mechanism.

Figure 2:
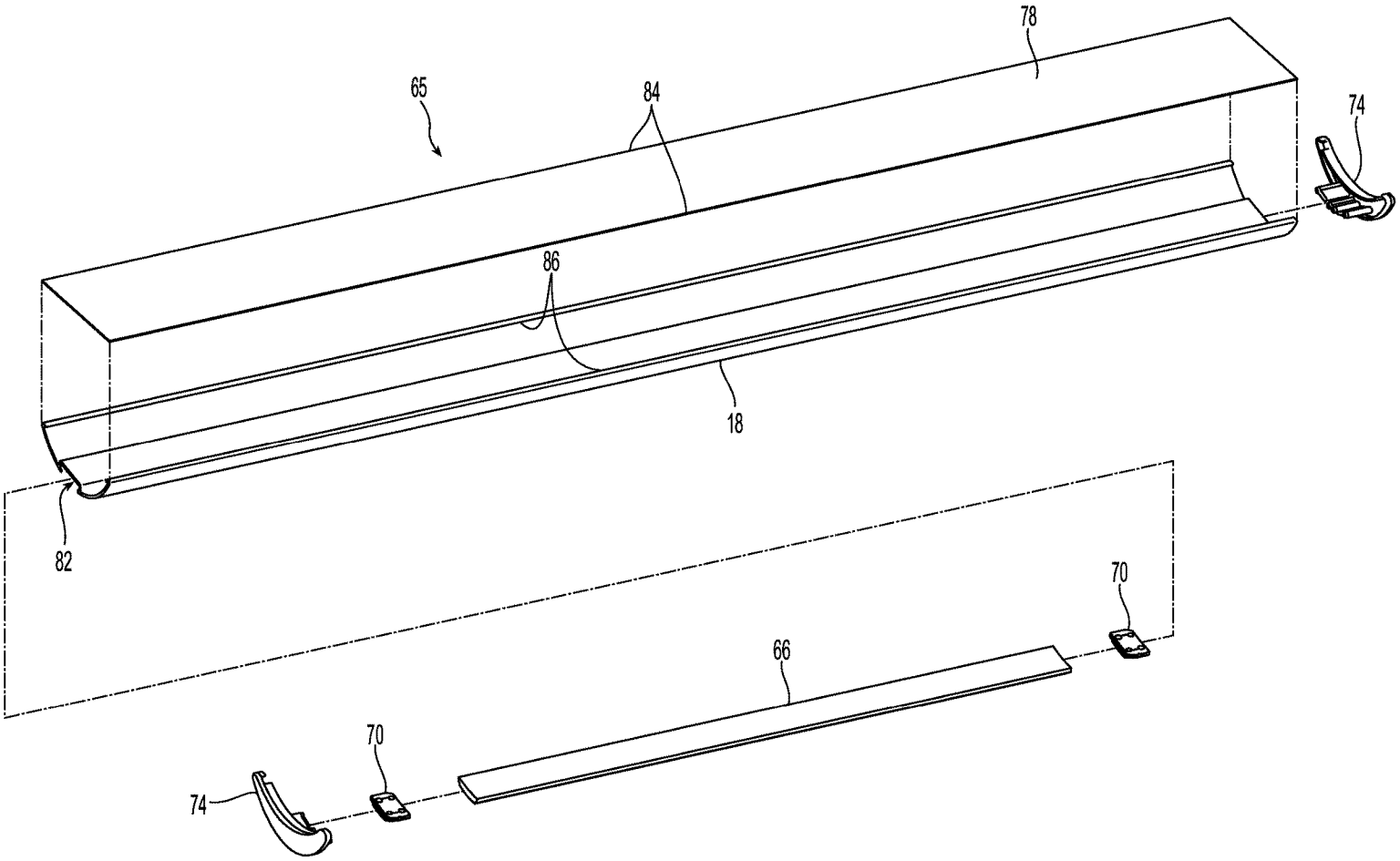
FIG. 2 is a front exploded view of a movable rail apparatus of the covering of FIG. 1 in accordance with some embodiments of the present disclosure.

FIG. 2 is a front exploded view of an illustrative embodiment of a rail apparatus formed in accordance with principles of the present invention. Rail apparatus 65, shown in FIG. 2, includes the rail 18 and an independent weight 66. The rail 18 of FIG. 2 includes a groove 82 formed in an exterior surface of the rail 18 and sized to receive the weight 66. The rail apparatus 65 may include a pair of securement members 70 configured to secure the weight 66 within the groove 62, a pair of end caps 74 configured to enclose the ends of the rail 18, and a top cover 78 configured to enclose a top side of the rail 18. The top cover 78 of FIG. 2 includes opposing edge portions 84 that are positioned beneath inturned flanges 86 of the rail 18 to secure the top cover 78 to the rail 18.

With continued reference to FIG. 2, the weight 66 may be formed, for example, as an elongate, rectilinear bar. The weight 66 may have a profile, for example, generally rectangular, sized to fit snugly within the groove 82. The length of the weight 66 need not extend the full length of the groove 82, but, in some illustrative embodiments, the weight 66 extends the full length of the groove 82. Although a single weight 66 is depicted, it should be appreciated multiple weights of various sizes and profiles may be utilized to provide a desired counterbalance and/or skew adjustment for the rail 18.

The weight 66 may serve the dual purpose of a skew weight and a counterbalance weight. As a skew weight, the weight 66 in the embodiment of FIG. 2 is movable along a length of the rail 18 to provide skew adjustment and counteract an asymmetric force applied to the rail 18 by a shade member 22 that tends to rotate the rail 18 about an axis 88 (see FIG. 3) that is orthogonal to its longitudinal axis 61 and to the plane of the shade member 22. In this role, the weight 66 of FIG. 2 ensures that the rail 18 is oriented substantially horizontally along a width of the shade member 22 defined between opposing vertical edges of the shade member 22. As a counterbalance weight, the weight 66 in the embodiment of FIG. 2 is positioned rearwardly of the longitudinal axis 61 of the rail 18 to counteract an asymmetric force applied to the rail 18 by a shade member 22 that tends to rotate the rail 18 about its longitudinal axis 61. In this role, the weight 66 of FIG. 2 ensures the rail 18 is oriented substantially horizontally along a depth of the shade member 22 defined between front and rear surfaces of the shade member 22.

Figure 3:
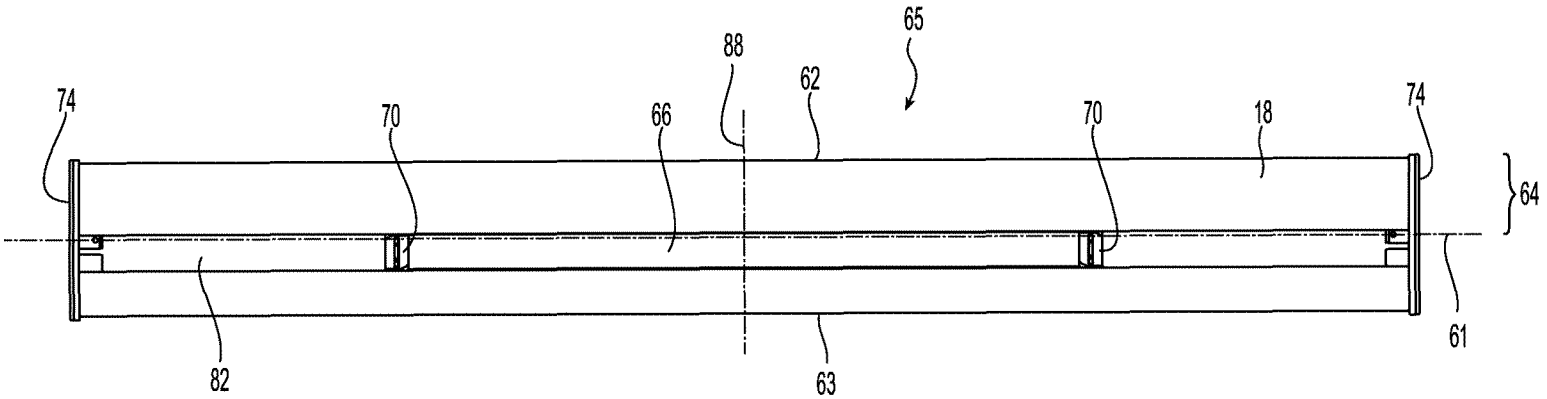
FIG. 3 is bottom plan view of the movable rail apparatus of FIG. 2 in accordance with some embodiments of the present disclosure.

FIG. 3 is a bottom plan view of an illustrative embodiment of the rail 18 in accordance with principles of the present invention. In the embodiment of FIG. 3, the groove 82 extends lengthwise along the length of the rail 18, and may extend along the entire length of the rail 18. The weight 66 in the embodiment of FIG. 3 is positioned within the groove 82 and may be slidable within the groove 82 along the length of the rail 18 toward either of the end caps 74 to provide skew adjustment. By moving the weight 66 along the length of the rail 18, a user can adjust the center of gravity of the rail 18 to counteract a force applied to the rail 18 by the shade member 22 that tends to rotate the rail 18 about an axis 88 that is orthogonal to its longitudinal axis 61 and to the plane of the shade member 22 (see FIG. 3), thereby maintaining the rail 18 in a horizontal orientation across a width dimension of the architectural opening.

The weight 66 may be clamped, interference fit, or otherwise secured within the groove 82 to maintain its desired position along the length of the rail 18. In the embodiment of FIG. 3, the securement members 70 are positioned within the groove 82 adjacent opposite ends of the weight 66 to inhibit movement of the weight 66 along a length of the rail 18. The securement members 70 may be interference fit or otherwise secured to the rail 18 within the groove 82. To reposition the weight 66 along the length of the rail 18, one or both of the securement members 70 may be slid within the groove 82 away from a respective end of the weight 66, the weight 66 may be slid within the groove 82 to its desired position, and then the securement members 70 may be repositioned adjacent the ends of the weight 66 to maintain the weight 66 in its new position.

With continued reference to FIG. 3, the weight 66 in this illustrative embodiment is offset rearwardly from the longitudinal axis 61 of the rail 18 to counterbalance a force applied to the rail 18 by the shade member 22 that tends to rotate the rail 18 about its longitudinal axis 61. The weight 66 in the embodiment of FIG. 3 is positioned closer to a rear edge 63 of the rail 18 than to a front edge 62 of the rail 18, thereby moving the center of gravity of the rail 18 towards the rear edge 63 of the rail 18 and creating an unbalanced or asymmetric rail 18 with an increased mass positioned in the rear portion 64 of the rail 18. The increased mass in the rear portion 64 of the rail 18 of FIG. 3 counterbalances a biasing force of the shade member 22 and may maintain the rail 18 in a horizontal orientation from its rear edge 63 to its front edge 62.

Figure 4:
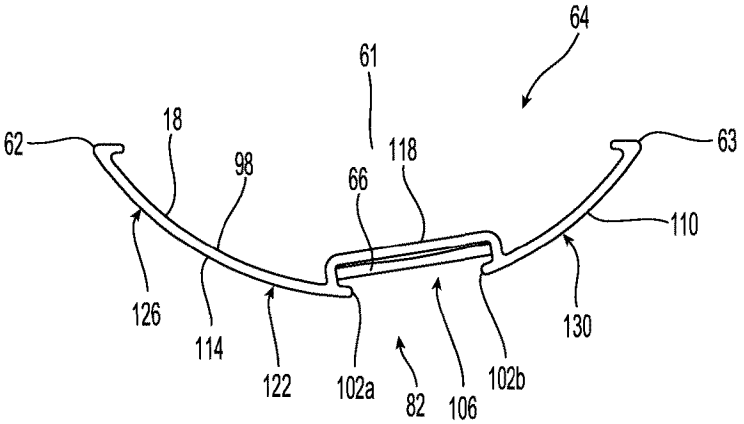
FIG. 4 is a right side elevation view of the movable rail apparatus of FIG. 2 with end caps and securement members not shown for discussion purposes in accordance with some embodiments of the present disclosure.

FIG. 4 is a right side elevation view of an illustrative embodiment of the rail 18 with the weight 66 located in the groove 82 in accordance with principles of the present invention. As shown in FIG. 4, the rail 18 may have an arcuate profile defined by a wall 98. The wall 98 in the embodiment of FIG. 4 extends from the front edge 62 to the rear edge 63 of the rail 18, and may have a substantially uniform thickness. Proximate the groove 82, the wall 98 may include opposing projections 102*a*, 102*b* that constrict an opening 106 of the groove 82 to inhibit removal of the weight 66 through the opening 106. The opposing projections 102*a*, 102*b* may extend lengthwise along the length of the rail 18 along the edges of the groove 82.

With continued reference to FIG. 4, the rail 18 in this illustrative embodiment has a substantially convex profile. The wall 98 of the rail 18 includes a rear portion 110, a front portion 114, and an intermediate portion 118 positioned between and interconnecting the rear and front portions 110, 114. The rear portion 110 may extend from the rear edge 63 of the rail 18 to the rear projection 102*b*, and the front portion 114 may extend from the front edge 62 of the rail 18 to the front projection 102*a*. The rear and front portions 110, 114 in the embodiment of FIG. 4 each have, for example, convex profiles and extend downwardly and inwardly from the rear and front edges 63, 62 to the rear and front projections 102*b*, 102*a*, respectively. The intermediate portion 118 in the embodiment of FIG. 4 interconnects the rear and front portions 110, 114 of the wall 98 to each other near the opposing projections 102*a*, 102*b*. The intermediate portion 118 may define the groove 82, and, as previously discussed, the projections 102*a*, 102*b* may constrict the opening 106 of the groove 82 to inhibit removal of the weight 66 from the groove 82 in a direction transverse to the longitudinal axis 61.

With continued reference to FIG. 4, a bottom surface 122 of the rail 18 may have a smooth surface extending from the front edge 62 to the rear edge 63 of the rail. The bottom surface 122 in FIG. 4 includes a forward surface 126 positioned forwardly of the groove 82 and a rearward surface 130 positioned rearwardly of the groove 82. The forward and rearward surfaces 126, 130 in the embodiment of FIG. 4 are separated from each other by the groove 82. The forward surface 126 of FIG. 4 forms the outer surface of the front portion 114 of the wall 98, and the rearward surface 130 of FIG. 4 forms the outer surface of the rear portion 110 of the wall 98. The forward surface 126 of the illustrated embodiment has a larger surface area than the rearward surface 130. In some embodiments, the rearward surface 130 includes indicia, such as safety warnings, which may be printed, engraved, etched, or otherwise formed in the bottom surface 122 of the rail 18, or may be in the form of a label that is adhesively attached to the rearward surface 130. The indicia may be located rearwardly of the weight 66, and thus may be minimally visible, if at all, during operation of the covering 10 (see FIGS. 5-7).

An illustrative example of a shade member 22 is shown in FIGS. 1 and 5-7 to which a movable rail 18 as described herein may be attached. Shade member 22 includes a front panel 38, a rear panel 42, and a plurality of vanes 46 extending between and interconnecting the front and rear panels 38, 42. The panels 38, 42 are vertically suspended from a roller 50 (see FIG. 1), may be generally planar, and may be oriented substantially parallel to each other. Referring to FIG. 1, the rail 18 holds the front and rear panels 38, 42 of the shade member 22 spaced apart from each other, and the weighting of the rail 18 holds the panels 38, 42 in an extended configuration covering the architectural opening. The rail 18 of FIG. 1 is attached to lower edges of the front panel 38 and the rear panel 42 and maintains the panels 38, 42 in a taut condition.

The shade member 22 may be biased into a particular configuration, such an open configuration or a closed configuration, by the vanes 46, for example. The vanes 46 of the illustrative shade member 22 extend substantially horizontally across a width of the panels 38, 42 and are vertically-spaced apart from one another. Each of the vanes 46 of the illustrative shade member 22 includes a front edge portion 54 attached to the front panel 38 and a rear edge portion 58 attached to the rear panel 42. The cross-sectional shape and the stiffness of the vanes 46 of FIG. 1 may bias the shade member 22 into a particular configuration or position.

Figure 5:
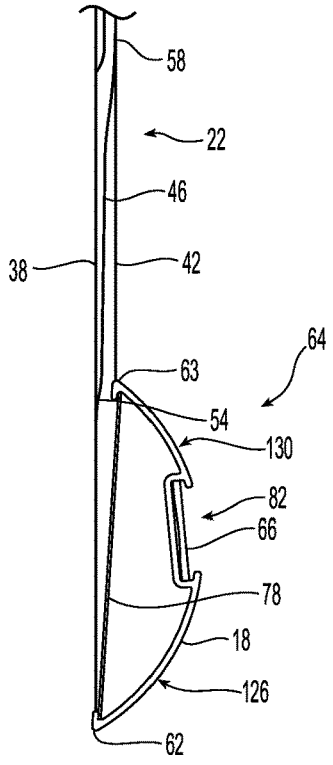
FIG. 5 is an enlarged, fragmentary right side elevation view of the covering of FIG. 1 showing the shade member in a closed configuration in accordance with some embodiments of the present disclosure.

The vanes 46 may be configured to bias the shade member 22 towards the closed configuration (see FIG. 5, for example). Referring to FIGS. 1 and 5-7, the vanes 46 of the illustrative embodiment have arcuate profiles and include downwardly-directed front edge portions 54 attached to the front panel 38 and upwardly-directed rear edge portions 58 attached to the rear panel 42. The vanes 46 in the illustrative embodiment bias the rear panel 42 upwardly due at least in part to the stiffness and the arcuate profile of the vanes 46.

The vanes 46 of the illustrative embodiment apply an asymmetric force to the rail 18 through the rear panel 42, which tends to rotate the rail 18 about a rail longitudinal axis 61 located equidistant from a front edge 62 and a rear edge 63 of the rail 18 (see FIGS. 3 and 4). The vanes 46 of the illustrative embodiment apply an upwardly-directed force to a rear portion 64 of the rail 18 via the rear panel 42, which tends to rotate the rail 18 in a counterclockwise direction when viewed from the right end of the rail 18 shown in FIGS. 1 and 4. To counteract this upward force, the rail 18 of the illustrative embodiment is weighted asymmetrically, with additional weight positioned in a rear portion 64 of the rail 18 between the longitudinal axis 61 and the rear edge 63 of the rail 18.

The additional weight in the rail 18 may be in the form of the weight 66. The weight 66 in the illustrative embodiment at least partially counteracts the bias of the vanes 46. The weight 66 in the illustrative embodiment pulls down the rear panel 42 that would otherwise be biased upwardly by the vanes 46 and maintains the rear panel 42 in a taut condition during operation of the covering 10. The weight 66 may ensure the rail 18 is oriented substantially horizontally along a depth of the shade member 22 defined between the front and rear panels 38, 42. In other words, the weight 66 may maintain the rail 18 in a horizontal configuration from its rear edge 63 to its front edge 62 when the shade member 22 of the illustrative embodiment is in the fully-open configuration depicted in FIGS. 1 and 7.

Figure 6:
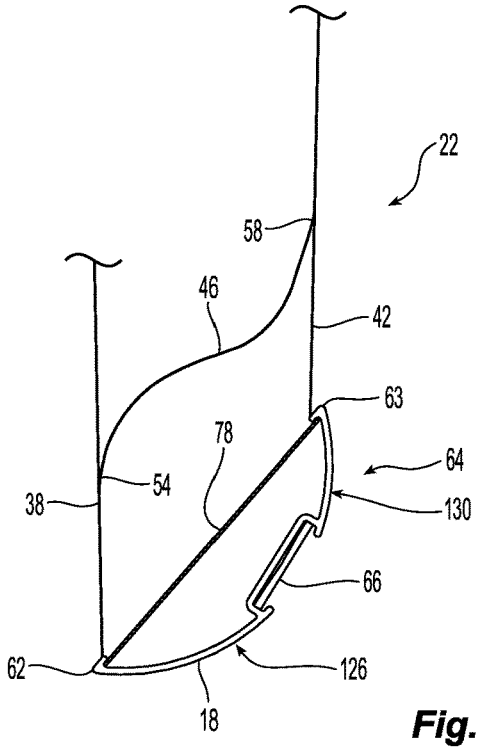
FIG. 6 is an enlarged, fragmentary right side elevation view of the covering of FIG. 1 showing the shade member in a partially-open configuration in accordance with some embodiments of the present disclosure.
Figure 7:
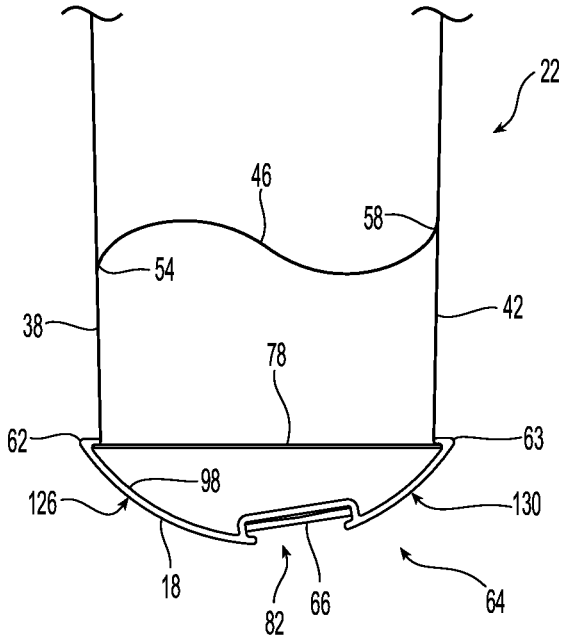
FIG. 7 is an enlarged, fragmentary right side elevation view of the covering of FIG. 1 showing the shade member in a fully-open configuration in accordance with some embodiments of the present disclosure.

FIG. 5 is an enlarged, fragmentary right side elevation view of an illustrative embodiment of the covering 10 (see FIG. 1) showing the shade member 22 in a closed configuration in accordance with principles of the present invention. FIG. 6 is an enlarged, fragmentary right side elevation view of an illustrative embodiment of the covering 10 (see FIG. 1) showing the shade member 22 in a partially-open configuration in accordance with principles of the present invention. FIG. 7 is an enlarged, fragmentary right side elevation view of an illustrative embodiment of the covering 10 (see FIG. 1) showing the shade member 22 in a fully-open configuration in accordance with principles of the present invention. When viewed in sequence, the rail 18 of the illustrative embodiment is rotated from the substantially vertical orientation (FIG. 5), through the partially-open configuration (FIG. 6), to the substantially horizontal orientation (FIG. 7) during operation of the covering 10, and vice versa. The rear edge 63 of the rail 18 may move downwardly, and the front edge 62 of the rail 18 may move upwardly and forwardly during opening of the shade member 22. The weight 66 of the illustrative embodiment assists the full opening of the shade member 22 by counterbalancing the stiffness of the vanes 46 to facilitate the downward movement of the rear edge 63 of the rail 18. During opening of the covering 10, the bottom surface 122 of the rail 18 may be turned upwardly and forwardly, and thus becomes visible, whereas the groove 82 may remain substantially hidden from view. For example, the groove 82 may be minimally visible or not visible at all during operation of the covering 10.

Referring to FIGS. 5-7, the rail 18 may be attached to lower edges of the front and rear panels 38, 42 of the shade member 22 near the front and rear edges 62, 63 of the rail 18, respectively. As previously discussed, the rail 18 may be weighted to apply more weight to the rear panel 42 than the front panel 42. The additional weight 66 applied to the rear panel 42 in the illustrative embodiment counterbalances the upward biasing of the rear panel 42 generated by, for example, the shape and stiffness of the vanes 46, thereby ensuring the rear panel 42 is taut in any operational configuration of the covering 10. The additional weight 66 may ensure the rail 18 and the vanes 46 are in a substantially horizontal configuration when the shade member 22 is in a fully-open configuration (see FIG. 7), thereby fully separating the panels 38, 42 and permitting maximum visibility through the shade member 22 between the vanes 46.

With continued reference to FIGS. 5-7, the weight 66 of the illustrative embodiment is visible from a rear side of the covering 10 (see FIG. 1) during operation of the covering 10. The weight 66 may be less visible from a front side than current rails, and preferably is almost not visible or not visible at all from a front side of the covering 10 during operation of the covering 10. Referring to FIG. 5, the shade member 22 is shown in a closed configuration in which the shade member 22 may be extended or retracted across the architectural opening. In this closed configuration, the shade member 22 may be extended or architectural opening by unwrapping the shade member 22 from, or wrapping the shade member 22 about, the roller 50 (see FIG. 1). As shown in FIG. 5, the front and rear panels 38, 42 of the illustrative shade member 22 are positioned near each other with the vanes 46 extending substantially vertically therebetween when the shade member 22 is in the closed configuration. The rail 18 of the illustrative embodiment is positioned in a substantially vertical orientation with the rear edge 63 of the rail 18 positioned substantially directly above the front edge 62 of the rail 18, and the weight 66 positioned in a substantially vertical orientation along the bottom surface 122 of the rail 18. The rail 18 may be positioned behind the front panel 38, and the weight 66 may be positioned at approximately 3 o'clock. The weight 66 may be visible from a rear side, but not a front side, of the shade member 22.

Referring to FIG. 6, the covering 10 is shown with the shade member 22 in a partially-open configuration. In this partially-open configuration, the front and rear panels 38, 42 of the illustrative shade member 22 are horizontally spaced apart from each other with the vanes 46 extending therebetween at an angle of about 45 degrees. The rail 18 in this illustrative embodiment is positioned in a similar orientation at an angle of about 45 degrees with the rear edge 63 of the rail 18 positioned above and rearward of the front edge 62 of the rail 18. The weight 66 may be positioned at about 4 o'clock. The weight 66 may be visible from a rear side, but not a front side, of the shade member 22. In this partially-open configuration, a portion of the forward surface 126 of the rail 18 may be visible from a front side of the shade member 22.

Referring to FIG. 7, the covering 10 is shown with the shade member 22 in a fully-extended, open configuration. In this open configuration, the front and rear panels 38, 42 of the illustrative shade member 22 are horizontally spaced apart from each other with the vanes 46 extending substantially horizontally therebetween. The spacing between the front and rear panels 38, 42 may be determined at least partially by the shape and stiffness of the vanes 46 and the distance between the attachment points of the front and rear panels 38, 42 to the rail 18. When the shade member 22 is in the fully-extended, open configuration, rotation of the roller 50 in either direction may cause the front and rear panels 38, 42 to move toward one another and the vanes 46 to re-orient into a more vertical alignment.

With continued reference to FIG. 7, when the shade member 22 is in the fully-extended, open configuration, the rail 18 of the illustrative embodiment is positioned in a substantially horizontal orientation. The rear edge 63 of the rail 18 may be positioned substantially directly behind the front edge 62 of the rail 18, and the weight 66 may be positioned in a substantially horizontal orientation along the bottom surface of the rail 18. The rail 18 in the illustrative embodiment is positioned below the front and rear panels 38, 42, and the weight 66 may be positioned between about 5 o'clock and 6 o'clock. The weight 66 may be visible from a rear side, but generally not visible from a front side, of the shade member 22. The front portion 114 of the wall 98 of the rail 18 may conceal the weight 66 from view from a front side of the shade member 22. In this fully-extended, open configuration, the forward surface 126 of the rail 18 of the illustrative embodiment is visible from a front side of the shade member 22. Indicia, such as safety warnings, may be positioned behind the groove 82, and thus may be hidden from view or at least visibility of the indicia may be minimized.

The shade member 22 of the illustrative embodiment may be constructed of substantially any type of material. The panels 38, 42 may be constructed of a flexible material (e.g., sheer fabric), and the vanes 46 may be constructed of a resilient material. The vanes 46 may be constructed of a material with sufficient stiffness to bias the shade member 22 towards a closed configuration in which the panels 38, 42 are located adjacent each other with the vanes 46 positioned therebetween in a substantially vertical orientation (see FIG. 5, for example). The vanes 46 may be sufficiently stiff to move the shade member 22 into the closed configuration when the rail 18 is not attached to the shade member 22. It should be understood that the illustrated shade member 22 is one example of a type of shade to which the movable rail 18 may be attached. The movable rail 18 may be used with other types of shades that may benefit from a rail that is weighted off-center from a longitudinal axis. For instance, another shade member that may benefit from the rail 18 is a pleated shade, such as that provided in U.S. Patent Publication Number 2015/0034262 A1. The rail 18 may be weighted for various reasons, such as counterbalancing a handle attached to the rail 18, counterbalancing a shade member having different materials that offset the balance of the shade member, or other imbalances of the rail or shade member.

The foregoing description has broad application. It should be appreciated that the concepts disclosed herein may apply to many types of shades, in addition to the shades described and depicted herein. Similarly, it should be appreciated that the concepts disclosed herein may apply to many types of weights, in addition to the skew weight described and depicted herein. For example, multiple discrete weights may be used and spaced along the length of the rail. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

The phrases "at least one", "one or more", and "and/or", as used herein, are open-ended expressions that are both conjunctive and disjunctive in operation. The term "a" or "an" entity, as used herein, refers to one or more of that entity. As such, the terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

What is claimed is:

1. A movable rail apparatus for a covering for an architectural opening, said rail apparatus comprising:

a rail having a front edge and a rear edge, a downwardly facing exterior surface extending between said front edge and said rear edge, said front edge of said rail configured and structured for coupling with one or more front support members of the covering, and said rear edge of said rail configured and structured for coupling with one or more rear support members of the covering so that the front and rear support members extend in a direction away from said downwardly facing exterior surface; and a groove formed in said downwardly facing exterior surface of said rail;

wherein:

said groove is positioned closer to said rear edge of said rail than said front edge of said rail and said groove is configured and adapted to have a weight positioned in said groove to apply more weight to said rear edge of said rail than said front edge of said rail to rotationally bias said rail about a longitudinal axis of said rail, and when the rail is maintained in a substantially horizontal orientation from the front edge to the rear edge of said rail, the groove is visible from a rear elevation view of the rear edge of said rail, but not from a front elevation view of the front edge of the rail; and said groove is substantially hidden from said front elevation view of said front edge of said rail.

2. The rail apparatus according to claim 1, wherein a wall of said rail includes opposing projections that constrict an opening of said groove to inhibit removal of said weight through said opening.

3. The rail apparatus according to claim 1, wherein:

said rail includes a wall having a rear portion and a front portion;

said rear portion of said wall extends from said rear edge of said rail to said groove and has a convex profile; and said front portion of said wall extends from said front edge of said rail to said groove and has a convex profile.

4. The rail apparatus according to claim 3, wherein an intermediate portion of said wall interconnects said front and rear portions of said wall and defines said groove.

5. The rail apparatus according to claim 4, wherein said front, rear, and intermediate portions of said wall have a substantially uniform thickness.

6. The rail apparatus according to claim 3, wherein:

said front portion of said wall has an outer surface;

said rear portion of said wall has an outer surface; and said outer surface of said front portion has a larger surface area than said outer surface of said rear portion.

7. The rail apparatus according to claim 2, further comprising a pair of securement members positioned within said groove adjacent opposite ends of said groove to inhibit movement of said weight along a length of said rail.

8. The rail apparatus according to claim 1, wherein when said rail is maintained in said substantially horizontal orientation from said front edge to said rear edge of said rail, more of a smooth bottom surface of said rail is visible from a front elevation view of said front edge of said rail than is visible from said rear elevation view of said rear edge of said rail.

9. The rail apparatus according to claim 1, wherein said rail includes indicia positioned rearwardly of said groove and substantially hidden from said front elevation view of the front edge of said rail.

10. The moveable rail apparatus according to claim 1, wherein the rail has a first coupling structured and configured for coupling to a front support member of a covering longitudinally extending in proximity to said front edge of the rail, and a second coupling structured and configured for coupling to a rear support member of the covering longitudinally extending in proximity to said rear edge of the rail.

11. The moveable rail apparatus according to claim 10, wherein the first coupling extends longitudinally along said front edge of the rail.

12. The moveable rail apparatus according to claim 1, wherein said rail is configured and structured to be separately couplable at different locations to the front support member and the rear support member.

13. The moveable rail apparatus according to claim 12, wherein said coupling location for the front support member extends longitudinally proximate said front edge of said rail and said coupling location for the rear support member extends longitudinally proximate the rear edge of said rail.

14. The rail of claim 1, wherein said weight is positionable along the longitudinal axis of said rail to affect skewing of said rail about an axis orthogonal to said longitudinal axis.

15. The rail of claim 1, wherein only a single groove for receiving said weight is formed in said downwardly facing exterior surface of said rail.

16. The rail of claim 1, wherein said downwardly facing exterior surface of said rail has a front portion extended between said front edge of said rail and said groove, wherein said front portion is free of grooves configured and structured for receiving said weight.

17. The rail apparatus according to claim 1, wherein at least one of the front support member and rear support member is a panel.

18. The rail apparatus according to claim 17, wherein the front edge and rear edge of the rail extend a longitudinal length and both the front support member and rear support members are panels, wherein each panel extends the longitudinal length of the respective front and rear edge of the rail.

19. The rail apparatus according to claim 1, wherein said weight is positioned within said groove formed in said downwardly facing exterior surface of said rail.

20. A covering for an architectural opening, said covering comprising:

an asymmetrically-biased shade member including a front support member, a rear support member, and a plurality of vanes extending between and interconnecting said front and rear support members; and a rail having a front edge and a rear edge, said rail extending between and coupled to bottom edges of said front support member and said rear support member of said shade member, the bottom edge of said rear support member being positioned closer to said rear edge of said rail than said front edge of said rail;

wherein:

said plurality of vanes bias said shade member towards a closed configuration;

said rail has an exterior bottom surface having a groove configured and adapted to have a weight positionable therein, wherein the groove is visible from a rear elevation view of the rear edge of said rail, but not from a front elevation view of the front edge of the rail, and said groove is positioned and configured closer to said rear edge of said rail than said front edge of said rail so that said groove is offset rearwardly from the longitudinal axis of said rail to apply more weight when said weight is positioned within said groove to said rear support member of said shade member than said front support member of said shade member to counteract the biasing force of said plurality of vanes.

21. The covering according to claim 20, wherein each vane of said plurality of vanes has an arcuate profile and includes a downwardly-directed front edge portion attached to said front support member and an upwardly-directed rear edge portion attached to said rear support member.

22. The covering according to claim 20, wherein:

said plurality of vanes bias said rear support member upwardly; and said weight is positioned within said groove and is configured to maintain said rear support member in a taut condition.

23. The covering according to claim 20, wherein said weight is secured to said rail.

24. The covering according to claim 20, wherein:

said rear edge of said rail moves downwardly and said front edge of said rail moves upwardly during opening of said shade member; and said weight is positioned within said groove and assists downward movement of said rear edge of said rail.

25. The covering of claim 20, wherein the exterior bottom surface of the rail is downwardly facing and only a single groove is formed in said exterior bottom surface for receiving said weight, and wherein said weight is positionable within said single groove.

26. The covering of claim 20, wherein the exterior bottom surface of said rail is downwardly facing and said downwardly facing exterior surface has a front exterior surface edge and a rear exterior surface edge, wherein said groove is formed in said downwardly facing exterior surface that is configured and adapted to receive said weight, and said groove is positioned closer to said rear exterior surface edge than to said front exterior surface edge, and wherein said downwardly facing exterior surface has a front portion between said front exterior surface edge and said groove, and said front portion is free of any grooves configured and structured to receive said weight.

27. The covering of claim 20, wherein said exterior bottom surface has:

a front edge corresponding to the front edge of the rail;

a rear edge corresponding to the rear edge of the rail;

said groove having a front side, a rear side, and a top surface exposed to the exterior;

a front surface extending from said front edge of said bottom surface to said front side of said groove; and a rear surface extending from said rear side of said groove to said rear edge of said bottom surface, wherein the groove is offset toward the rear edge of the bottom surface such that the extent of said front surface from said front edge of said bottom surface to said front side of said groove is larger than the extent of said rear surface from said rear side of said groove to said rear edge of said bottom surface.

28. The covering according to claim 20, wherein at least one of the front support member and rear support member is a panel, wherein the panel extends the length of said rail.

29. The covering according to claim 20, wherein said weight is positioned within said groove formed in said rail.

30. A covering for an architectural opening, said covering comprising:

a shade member including a front support member, a rear support member, and a plurality of vanes extending between and interconnecting said front and rear support members;

a rail having a front edge and a rear edge, said rail extending between and coupled to lower edges of said front and rear support members of said shade member, said lower edge of said rear support member being positioned closer to said rear edge of said rail than said front edge of said rail; and a groove formed in a downwardly-facing exterior surface of said rail;

wherein;

said plurality of vanes bias said shade member towards a closed configuration;

said groove is positioned and configured closer to said rear edge of said rail than said front edge of said rail so that said groove is offset rearwardly from the longitudinal axis of said rail, wherein said groove is configured to have a weight positionable therein to apply more weight to said rear support member of said shade member than said front support member of said shade member when said weight is positioned within said groove to counteract the biasing force of said plurality of vanes; and said shade member is positionable in an open configuration in which said rail extends in a substantially horizontal orientation between said front and rear support members of said shade member and said groove is visible from a rear elevation view of the rear edge of said rail and said groove is substantially hidden from a front elevation view of said shade member.

31. The covering according to claim 30, wherein in the closed configuration of said shade member said rail is in a substantially vertical orientation and in the open configuration of said shade member said rail is in a substantially horizontal orientation.

32. The covering according to claim 31, wherein said rail is rotatable between said substantially vertical orientation and said substantially horizontal orientation during operation of said covering.

33. The covering according to claim 30, wherein in the closed configuration of said shade member said rail is positioned behind said front support member.

34. The covering according to claim 30, wherein in the open configuration of said shade member said rail is positioned beneath said front and rear support members.

35. The covering according to claim 30, wherein said exterior surface of said rail extends from a front side of said shade member to a rear side of said shade member.

36. The covering according to claim 30, wherein said groove is positioned closer to said rear support member than said front support member and said weight is positioned within said groove so that said weight is not visible from a front side of said shade member, when in the open configuration.

37. The rail of claim 30, wherein only a single groove for receiving the weight is formed in said downwardly facing exterior surface.

38. The rail of claim 30, wherein said downwardly facing surface has a front exterior edge and a rear exterior edge, the front exterior edge located closer to said front panel, and said downwardly facing exterior surface of said rail has a front portion extending between the front exterior edge and said groove, wherein said front edge portion is free of any grooves configured and structured for receiving said weight.

39. The covering according to claim 30, wherein at least one of the front support member and rear support member is a panel, wherein the panel extends the length of said rail.

40. The covering according to claim 30, wherein said weight is positioned within said groove and movable within said groove along the longitudinal axis of said rail to affect skewing of said rail about an axis orthogonal to said longitudinal axis.

41. The covering according to claim 30, wherein:

said rail includes a wall having a rear portion and a front portion;

said rear portion of said wall extends from said rear edge of said rail to said groove and has a convex profile; and said front portion of said wall extends from said front edge of said rail to said groove and has a convex profile, wherein an intermediate portion of said wall interconnects said front and rear portions of said wall and defines said groove.

* * * * *